US005895599A

United States Patent [19]

Nivoche

[11] Patent Number: 5,895,599

[45] Date of Patent: Apr. 20, 1999

[54] INDUCTION HEATING DEVICE AND CONTINUOUS TREATMENT INSTALLATION INCLUDING SAME

[75] Inventor: Claude Andre Nivoche, Elancourt, France

[73] Assignee: Selas S.A., Gennevilliers, France

[21] Appl. No.: 08/905,088

[22] Filed: Aug. 1, 1997

[30] Foreign Application Priority Data

Aug. 2, 1996 [FR] France ..... 96 09823

[51] Int. Cl.[6] ..... H05B 6/26

[52] U.S. Cl. ..... 219/651; 219/653; 219/675

[58] Field of Search ..... 219/602, 609, 219/635, 645, 646, 651, 653, 655, 672, 675, 657

[56] References Cited

U.S. PATENT DOCUMENTS

| | | | |
|---|---|---|---|
| 1,749,770 | 3/1930 | Fourment . | |
| 2,453,019 | 11/1948 | King | 219/651 |
| 2,881,297 | 4/1959 | Friedman | 219/651 |
| 3,860,737 | 1/1975 | Moscatello | 219/651 |
| 4,227,061 | 10/1980 | Westfall et al. | 219/651 |
| 4,370,357 | 1/1983 | Swartz | 427/46 |
| 4,533,806 | 8/1985 | Kawasaki et al. | 219/651 |
| 5,412,185 | 5/1995 | Sturman, Jr. et al. | 219/651 |
| 5,573,689 | 11/1996 | Fukuoka et al. | 219/686 |

FOREIGN PATENT DOCUMENTS

| | | |
|---|---|---|
| 57-019336 | 1/1982 | Japan . |
| 2155740 | 9/1985 | United Kingdom . |

*Primary Examiner*—Tu Ba Hoang

*Attorney, Agent, or Firm*—Bachman & LaPointe, P.C.

[57] ABSTRACT

A device for induction heating a continuously moving metal product in a protective atmosphere includes an induction system. A non-metallic and gas-tight enclosure is disposed around the moving product, between the product and the induction system. Uses include an installation for continuous heat treatment of a moving product, such as a steel strip or wire, in a protective atmosphere, between a fast cooling chamber and an intermediate temperature maintaining chamber.

13 Claims, 2 Drawing Sheets

FIG_1
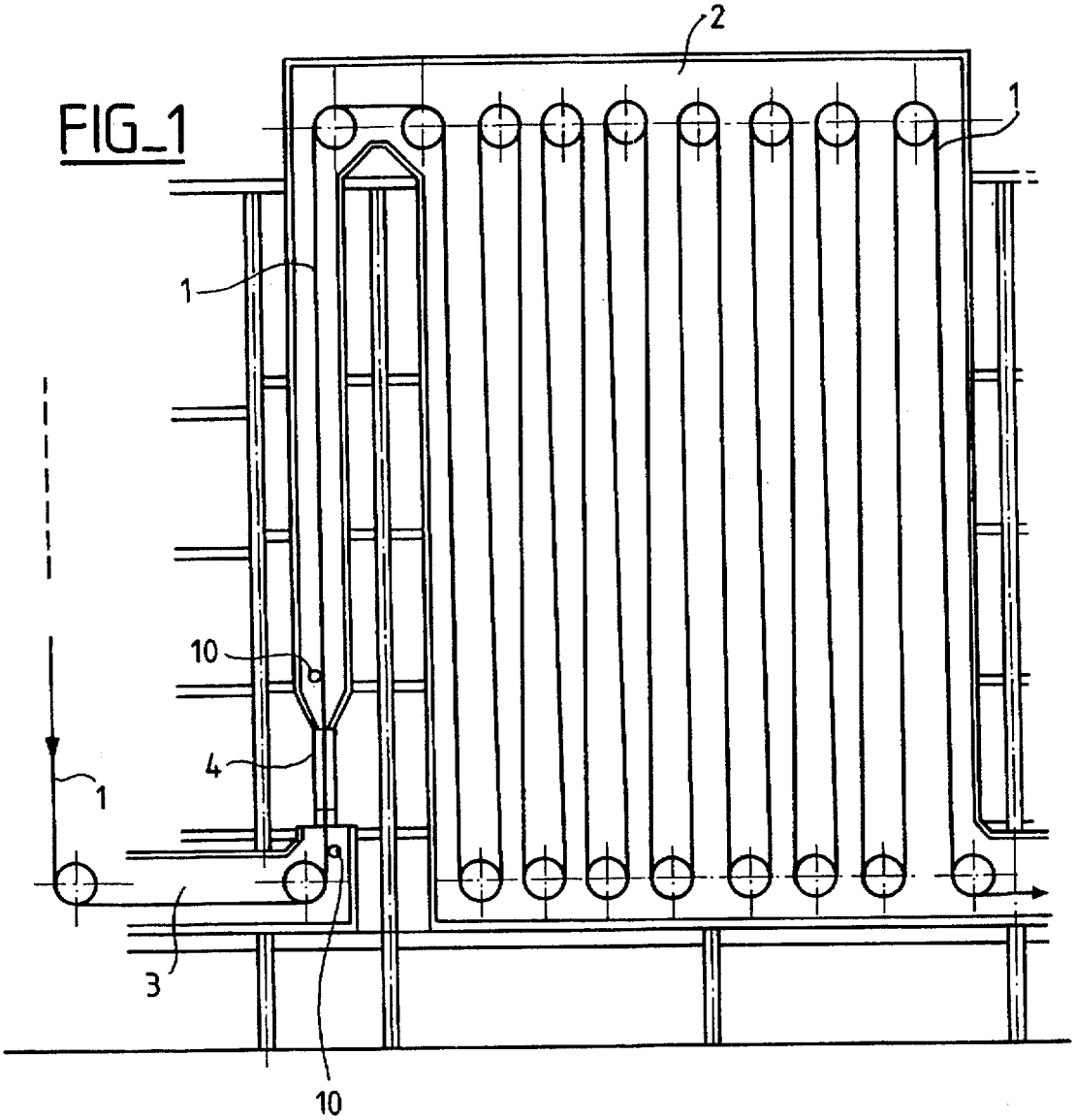
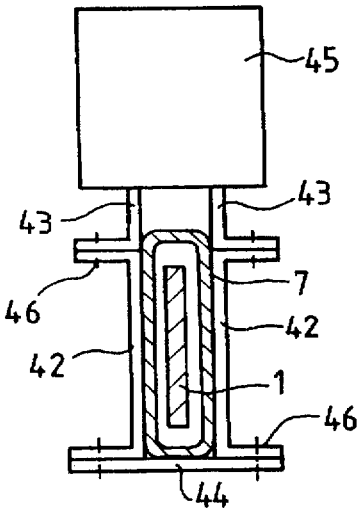
FIG_2

INDUCTION HEATING DEVICE AND CONTINUOUS TREATMENT INSTALLATION INCLUDING SAME

BACKGROUND OF THE INVENTION

1. Field of the Invention

The present invention concerns a device for induction heating a metal product moving continuously in a protective atmosphere.

It also concerns an installation for continuous heat treatment of a moving product incorporating a device of the above kind.

2. Description of the Prior Art

The present invention applies more particularly to heat treatment in a protective atmosphere as carried out on hot coating lines for galvanization, aluminization, etc and continuous heat treatment lines such as continuous annealing lines for steel plate or patenting lines for steel wire.

Induction heating devices have long been used to heat moving metal products. The inductor employed generally comprises one or more turns carrying the high-frequency current and completely surrounding the moving product. This inductor creates a longitudinal flux, i.e. a flux in the direction of motion of the product, and thereby heats magnetic materials.

Another induction heating device that is known in itself includes a turn carrying the current disposed in a plane parallel to the surface of the moving product so that the transverse magnetic flux is perpendicular to the surface of the product.

However, if the moving product is not coated and is treated at a temperature at which is may oxidize, induction heating must be carried out in a protective atmosphere, such as a mixture of nitrogen and hydrogen, and the enclosure of the induction heating device must be totally airtight in order to prevent oxidation of the product.

In applications of this type of prior art induction heating device, as described in French patent 2 688 802, for example, an induction heating device placed directly within an airtight enclosure is used.

This airtight seal all around the induction means requires airtight lead-throughs for the electrical power supply connections to the inductor and for the cooling water circuits for cooling the induction means.

These water circuits inside the airtight enclosure represent a high risk to the quality of the protective atmosphere because the slightest leak of water will pollute this atmosphere and may oxidize the product.

Moreover, placing the inductor in the airtight enclosure enormously complicates maintenance and requires the provision of adequate openings and handling means for removing the entire induction device form the enclosure.

What is more, the moving product to be treated must necessarily be cut when the induction means are removed, unless an opening is provided in the induction means surrounding the moving product.

Additionally, when the induction means are disposed inside a furnace, support means must be provided that do not conduct electricity and that are resistant to very high temperatures.

Finally, any work on the induction means entails shutting down the entire installation because the air and gas seal is no longer assured.

In prior art induction heating devices like those described in patents U.S. Pat. No. 1,749,700 and GB 2 155 740, the induction means are disposed outside a gas-tight enclosure adapted to maintain a protective atmosphere around the moving metal product.

However, in these embodiments there is no electrically insulative enclosure extending beyond the induction means.

Conductive parts of the enclosure can therefore carry electrical currents induced by the induction flux returning to the induction means.

An aim of the present invention is to remedy the aforementioned drawbacks and to propose an induction heating device for a moving metal product in a protective atmosphere guaranteeing the best possible air and gas seal around the moving product, facilitating work on the induction means and limiting overheating of the device.

SUMMARY OF THE INVENTION

The present invention consists in a device for induction heating a metal product moving continuously in a protective atmosphere, comprising induction means and a thermally and electrically insulative gas-tight enclosure disposed around said moving product, between said product and said induction means, said induction means comprising at least one turn of a conductive material connected to a high-frequency current generator and extending around said moving product in a plane perpendicular to the direction of movement of said product, said gas-tight enclosure being disposed within said turn or turns of said induction means and extending a sufficient distance upstream and downstream of said induction means in said direction of movement to create an area crossed by the return induction flux.

This sealed enclosure creates an area in which the induction flux returns to the induction means without heating the metal part.

Accordingly, by virtue of the invention, a seal is no longer provided around the induction means but simply between the induction means and the moving products.

It is no longer necessary to provide gas-tight lead-throughs for supplying current and water to the induction means.

Furthermore, work on the induction means, in particular to demount them, does not disturb the protective atmosphere surrounding the moving products.

Even if the induction means completely surround the moving products, the induction means can be worked on and demounted while the moving product continues to be protected by the gas-tight enclosure.

In accordance with another aspect of the invention, an installation for continuous heat treatment of a moving product, such as a steel strip or wire, in a protective atmosphere, comprises a plurality of successive heat treatment chambers.

In accordance with the invention, the above installation comprises an induction heating section comprising a heating device in accordance with the invention, a transfer tunnel through which the moving product travels only once connecting the induction heating device to said treatment chambers.

Thus the induction heating device heats the steel strip or wire in a furnace section in which the strip or wire travels through the transfer tunnel only once so that all of the perimeter of the induction heating device is accessible in the open air.

Other features and advantages of the invention will emerge further from the following description.

BRIEF DESCRIPTION OF THE DRAWINGS

In the accompanying drawings, given by way of non-limiting example:

FIG. 1 is a schematic view of part of a heat treatment installation comprising an induction heating section followed by an intermediate temperature maintaining chamber.

FIG. 2 is a schematic view of an induction heating device of the invention.

DETAILED DESCRIPTION OF THE PREFERRED EMBODIMENT

The induction heating device is described hereinafter in an application to the continuous heat treatment of a moving product such as a strip 1 in a protective atmosphere.

This type of heat treatment can equally be applied to a moving steel wire.

The protective atmosphere is generally a mixture of nitrogen and hydrogen and prevents oxidation of the product during treatment. In a manner that is known in itself, an installation of the above king may comprise in succession a chamber for heating the strip 1 to a temperature of 600° C. to 900° C., a temperature maintaining chamber, a slow cooling chamber, a fast cooling chamber, an induction heating section, an intermediate temperature maintaining chamber and finally a final cooling chamber.

In FIG. 1, the strip 1 leaves a fast cooling chamber, on the left in the figure, and passes through a transfer tunnel 3 and an induction heating section before entering an intermediate temperature maintaining chamber 2.

The various heat treatment chambers are surrounded by sealing means maintaining inside each of the chambers a protective atmosphere of reducing gas made up of a nitrogen/hydrogen mixture with a low dew point and a very low level of residual oxygen.

The strip 1 passes through the treatment chambers 2 in one or more vertical runs separated by jockey rollers.

Figure 3A:
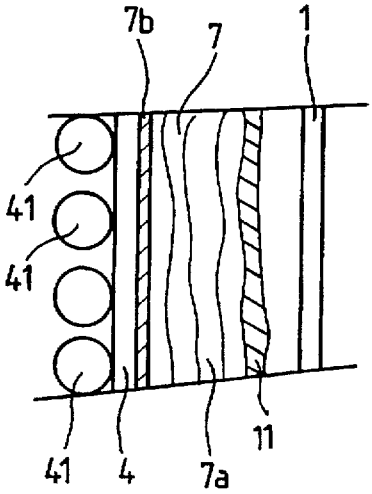
FIG. 3A is a view of the detail A from FIG. 3 to a larger scale.
Figure 3:
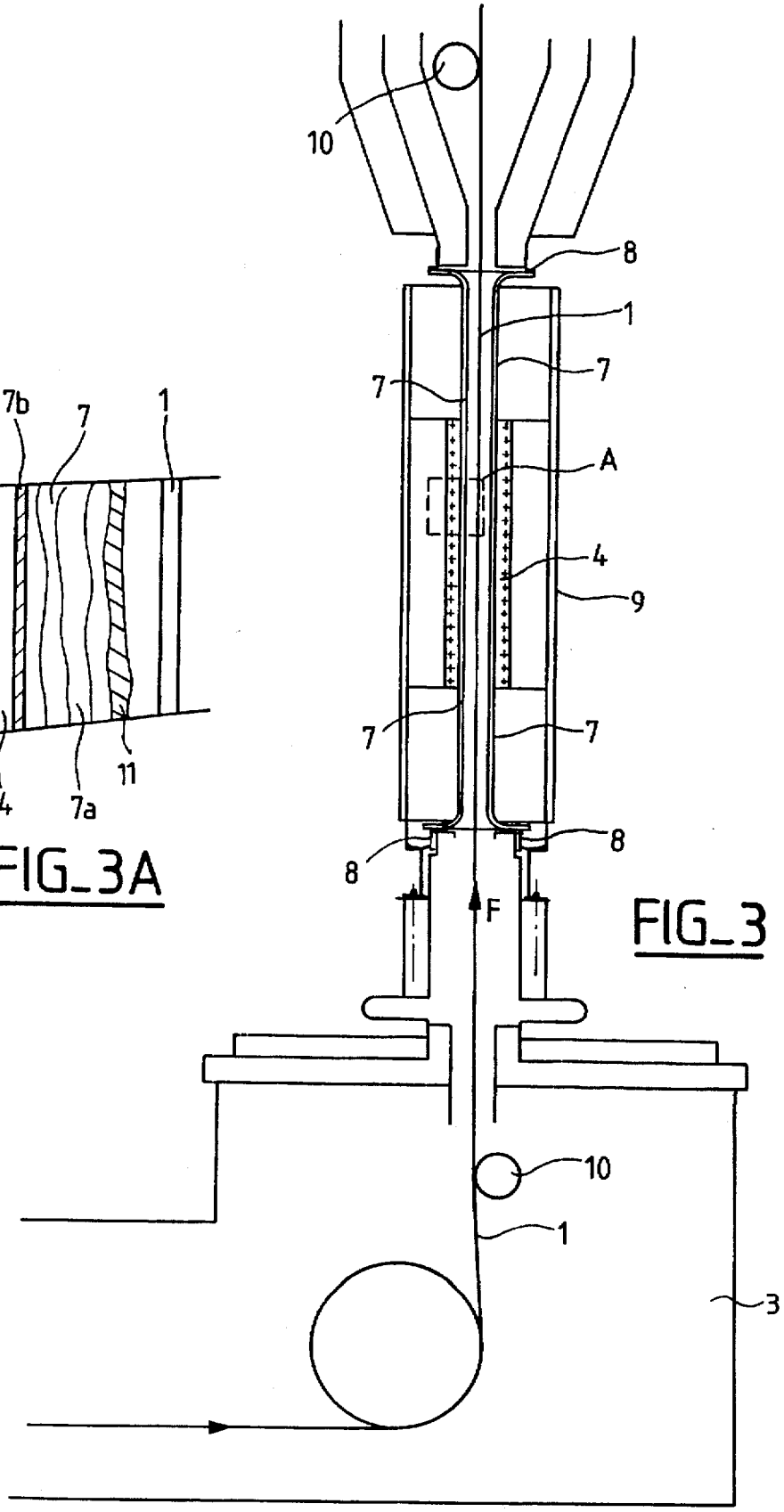
FIG. 3 is an elevation view of an induction heating device of the invention.

As shown in FIG. 3, the induction heating device of the invention comprises induction means 4 and a non metallic gas-tight enclosure 7 disposed around the moving product 1, between the product 1 and the induction means 4. The gas-tight enclosure 7 is thermally and electrically insulative and therefore surrounds the moving product with a non-conductive enclosure.

In this example, and as shown in FIG. 2, the induction means 4 comprise at least one turn of conductive material connected to a high-frequency current generator 45 and extending around the moving product 1 in a plane perpendicular to the direction F in which this product moves.

Thus the gas-tight enclosure is inside the turn of the induction means 4.

The gas-tight enclosure 7 extends a sufficient distance upstream and downstream of the induction means 4, parallel to the direction F of movement, to create an area crossed by the return induction flux.

This distance is equal to at least 200 mm and preferably equal to 300 mm.

The gas-tight enclosure being non-conductive, it does not carry any current induced by the return induction flux.

Of course, FIG. 3 shows a single inductor consisting of a single turn. A plurality of inductors 4 could be disposed in succession in the direction F of movement, however, the inductors being separated by a distance of at least 100 mm, a single gas-tight enclosure 7 protecting the strip 1 throughout the induction heating section.

The gas tight enclosure 7 is connected in a gas-tight manner to the treatment chambers because the induction heating device is designed to be disposed on the upstream side of or between these chambers to treat the moving product in a protective atmosphere.

These gas-tight connections can be made by flanges 8 and gaskets in the manner known in itself, or by any other method known in itself.

The gas-tight enclosure 7 in this example comprises a flexible sleeve 7 comprising one or more layers **7*a* of thermally and electrically insulative fabric coated externally with a film 7*b*** of gas-tight material resistant to a temperature of at least 100° C.

In this example, the ambient temperature in the induction heating section never exceeds 400° C. and the flexible sleeve 7 is made up of seven layers **7*a* of glass fiber fabric covered externally with a gas-tight film 7*b* of polytetrafluorethylene. The insulative fabric 7*a* of the sleeve could also be made from ceramic fibers. The flexible sleeve 7 is tensioned between the fixing flanges 8 at each end and is pressed against the interior walls of the induction means 4** by the pressure inside the furnace. This pressure is in the order of 100 Pa to 200 Pa.

If the induction heating device is to be installed in a hotter region of the installation, like the heating furnace proper, the gas-tight enclosure 7 may further comprise a lined non-gas-tight refractory material muffle 11 externally of the sleeve.

A gas-tight ceramic sheath can equally well be used as the gas-tight enclosure.

As shown more clearly in FIGS. 2 and 3A, the inductor(s) 4 comprise(s) a single rectangular section turn around the moving product 1 and comprising three metal plates 42, 43, 44 to which are welded water coils 41 for cooling the induction means 4.

The metal plates 42, 43, 44 are assembled in such a manner that they can be demounted from each other and possibly from the current generator 45.

In this example, the inductor 4 comprises five copper plates: two plates 43 connected to the current generator 45, two plates 42 face to face and forming the flanks of the turn parallel to the moving strip 1, and a plate 44 closing the side of the turn opposite the current generator 45. These plates are clamped tightly together by removable fixing means 46, such as bolts 46, in order to assure a perfect electrical contact.

This structure of the inductors 4 enables work to be carried out on the inductors 4 without cutting the strip 1 or opening the gas-tight enclosure 7, after removing the fixings of the plates.

In this example, the frequencies of the currents used are greater than 15 kHz, preferably greater than 30 kHz.

All of the space comprising the induction means 4 and the gas-tight enclosure 7 is preferably surrounded by a non-gas-tight protective casing 9 preventing any continuous electrical circuit around the inductor. Stabilizing rollers 10 on respective opposite sides of the induction heating section can slightly deflect the strip 1 to reduce the camber of the strip 1, if necessary, and position it at the center of the induction means 4.

The plates 42, 43, 44 and the coils 41 are usually made entirely of copper.

A transfer tunnel 3 through which the moving product 1 passes only once connects the induction heating device to the fast cooling chamber (not shown) and to the intermediate temperature maintaining chamber 2.

It is essential for the induction heating device to be installed in a section of the furnace through which the strip passes only once so as to have access to it all around its perimeter in the open air.

Of course, many modifications can be made to the example described hereinabove with out departing from the scope of the invention.

There is claimed:

1. A device for induction heating a metal product moving continuously in a protective atmosphere, comprising induction means and a thermally and electrically insulative gas-tight enclosure disposed around said moving product, between said product and said induction means, said induction means comprising at least one turn of a conductive material connected to a high-frequency current generator and extending around said moving product in a plane perpendicular to the direction of movement of said product, said gas-light enclosure being disposed within said at least one turn of said induction means and extending a distance equal to at least 200 mm upstream and downstream of said induction means in said direction of movement to create an area crossed by a return induction flux.

2. The heating device claimed in claim 1 disposed on an upstream side of at least one chamber for treatment of said moving product in said protective atmosphere wherein said gas-tight enclosure is connected in a gas-tight manner to said at least one treatment chamber.

3. The heating device claimed in claim 1 disposed between chambers for treatment of said moving product in said protective atmosphere wherein said gas-tight enclosure is connected in a gas-tight manner to said treatment chambers.

4. The heating device claimed in claim 1 wherein said gas-tight enclosure comprises a flexible sleeve comprising at least one layer of thermally and electrically insulative fabric coated externally with a film of gas-tight material resistant to a temperature of at least 100° C.

5. The heating device claimed in claim 4 wherein said insulative fabric of said sleeve is a glass fiber or ceramic fiber fabric.

6. The heating device claimed in claim 4 wherein said film is of polytetrafluorethylene.

7. The heating device claimed in claim 4 wherein said gas-tight enclosure further comprises a lined refractory material muffle externally of said sleeve.

8. The heating device claimed in claim 1 wherein said gas-tight enclosure is a gas-tight ceramic sheath.

9. The heating device claimed in claim 1 wherein said induction means comprise at least one inductor consisting of a single rectangular section turn around said moving product and comprising at least three metal plates demountably assembled together and to a current generator.

10. An installation for continuous heat treatment of a moving product in a protective atmosphere comprising a plurality of successive heat treatment chambers, an induction heating section comprising a heating device as claimed in claim 1, and transfer tunnel through which said moving product travels only once, said transfer tunnel connecting said induction heating device to said treatment chambers.

11. The heat treatment installation claimed in claim 10 wherein a non-gas-tight protective casing surrounds said induction means and said gas-tight enclosure, said non-gas-tight protective casing preventing any continuous electrical circuit around said induction means.

12. A heat treatment installation as claimed in claim 10 comprising stabilizing rollers disposed on respective opposite sides of said induction heating section and adapted to apply a slight deflection to said strip so as to reduce the camber of said strip and to position said strip at the center of said induction means.

13. The heating device of claim 1, wherein said distance is equal to 300 nm.

* * * * *